United States Patent [19]

Yamada et al.

[11] Patent Number: 4,537,170

[45] Date of Patent: Aug. 27, 1985

[54] DISTRIBUTION TYPE FUEL INJECTION PUMP

[75] Inventors: Keiichi Yamada; Hideyuki Kimura, both of Higashi-Matsuyama, Japan

[73] Assignee: Diesel Kiki Co., Ltd., Tokyo, Japan

[21] Appl. No.: 585,218

[22] Filed: Feb. 28, 1984

[51] Int. Cl.[3] ..... F02M 41/00

[52] U.S. Cl. ..... 123/449; 417/289

[58] Field of Search ..... 123/449, 229, 300; 417/289

[56] References Cited

U.S. PATENT DOCUMENTS

| | | | |
|---|---|---|---|
| 4,168,690 | 9/1979 | Hofer | 123/449 |
| 4,407,249 | 10/1983 | Eheim | 123/449 |
| 4,463,726 | 8/1984 | Roca-Nieiga et al. | 123/449 |

FOREIGN PATENT DOCUMENTS

| | | | |
|---|---|---|---|
| 3018791 | 11/1981 | Fed. Rep. of Germany | 123/449 |
| 134222 | 10/1979 | Japan | 123/449 |
| 65852 | 4/1982 | Japan | 123/449 |

*Primary Examiner*—Magdalen Y. C. Moy

*Attorney, Agent, or Firm*—Wenderoth, Lind & Ponack

[57] ABSTRACT

In a distributor type fuel injection pump in which fuel is sucked and pressurized by a reciprocating and rotating plunger, and the pressurized fuel is fed under pressure to each fuel injection nozzle from a distribution port by means of a distribution path, the improvement constituted by a delivery valve to be provided in the distribution path is omitted or a delivery valve having a large suction return quantity is provided, and an auxiliary port is provided in the plunger, and a groove for taking out the pressure when it is aligned with the auxiliary port is formed in the plunger barrel, and a uniform pressure slit is formed on the plunger which is at an identical position with that of the distribution port and being circumferentially offset by a proper angle, and the uniform pressure slit is communicated with the groove for taking out the pressure by means of a communicating path, and a pressure equalizing valve is provided in the communicating path, whereby non-continuous injection in a low speed zone can be prevented while the residual pressure before the injection can be set at high pressure, and also, the generation of a secondary injection can be curbed on account of the pressure after the injection being zero or the pressure after the injection being lowered to near zero.

6 Claims, 5 Drawing Figures

DISTRIBUTION TYPE FUEL INJECTION PUMP

FIELD OF THE INVENTION

This invention relates to a distribution type fuel injection pump for suction and distribution of fuel by a reciprocating and rotating plunger.

BACKGROUND OF THE INVENTION

In the distribution type fuel injection pump, the internal pressure (residual pressure) of an injection pipe from the delivery valve to the fuel injection nozzle is arranged to be kept at a constant pressure by the delivery valve. This is because of the fact that in case the pressure in the injection pipe is instable, irregular injection occurs, and if the residual pressure changes for each rotation, problems such as occurrence of lack of continuity of the injection characteristics occur.

A higher internal pressure (residual pressure) in the injection pipe results in a higher maximum internal pressure in the pipe and produces the merit of eliminating a phenomenon that the opening of the valve of the injection nozzle in a low speed zone (idling time) is at last effected by a secondary wave, or tertiary wave, not a primary wave, but inversely, there is a demerit that secondary injection occurs easily.

However, at present the residual pressure meeting both requirements is set by the delivery valve, and the problems of generation of secondary injection and instability of injection in the low speed zone have not been solved.

SUMMARY OF THE INVENTION

An object of this invention is to improve the reliability of the injection by eliminating non-continuous injection at low speed rotation time such as idling time through generation of proper residual pressure in the injection pipe by supplying the pressure before the supply of fuel for injection.

Another object of this invention is to prevent secondary injection at high speed rotation time by lowering the residual pressure simultaneously with the completion of injection to zero or near zero.

For these objects, the construction of this invention provides a distribution type fuel injection pump in which fuel is sucked and pressurized by a reciprocating and rotating plunger, and the pressurized fuel is pressure fed to each fuel injection nozzle from a distribution port by means of each distribution path, and in which an auxiliary port is provided in the plunger, and a groove for taking out the pressure when it is superposed with this auxiliary port is formed in a plunger barrel, and a uniform pressure slit which is at an identical position with that of the distribution port and being staggered by a proper angle is formed in the plunger, and the uniform pressure slit is communicated with the groove for taking out the pressure by means of a communicating path, and a pressure equalizing valve is provided in the communicating path.

Accordingly, the internal pressure in the injection pipe is lowered rapidly to zero or near zero simultaneously with the completion of injection, and the pressure taken out from the auxiliary port formed in the plunger and the groove formed in the plunger barrel is supplied into the injection pipe from the equalizing pressure port at a position opposed to the distribution port, and the desired residual pressure can be generated in the injection pipe before the supply of fuel for injection.

BRIEF DESCRIPTON OF THE DRAWINGS

DETAILED DESCRIPTION OF THE INVENTION

Figure 1:
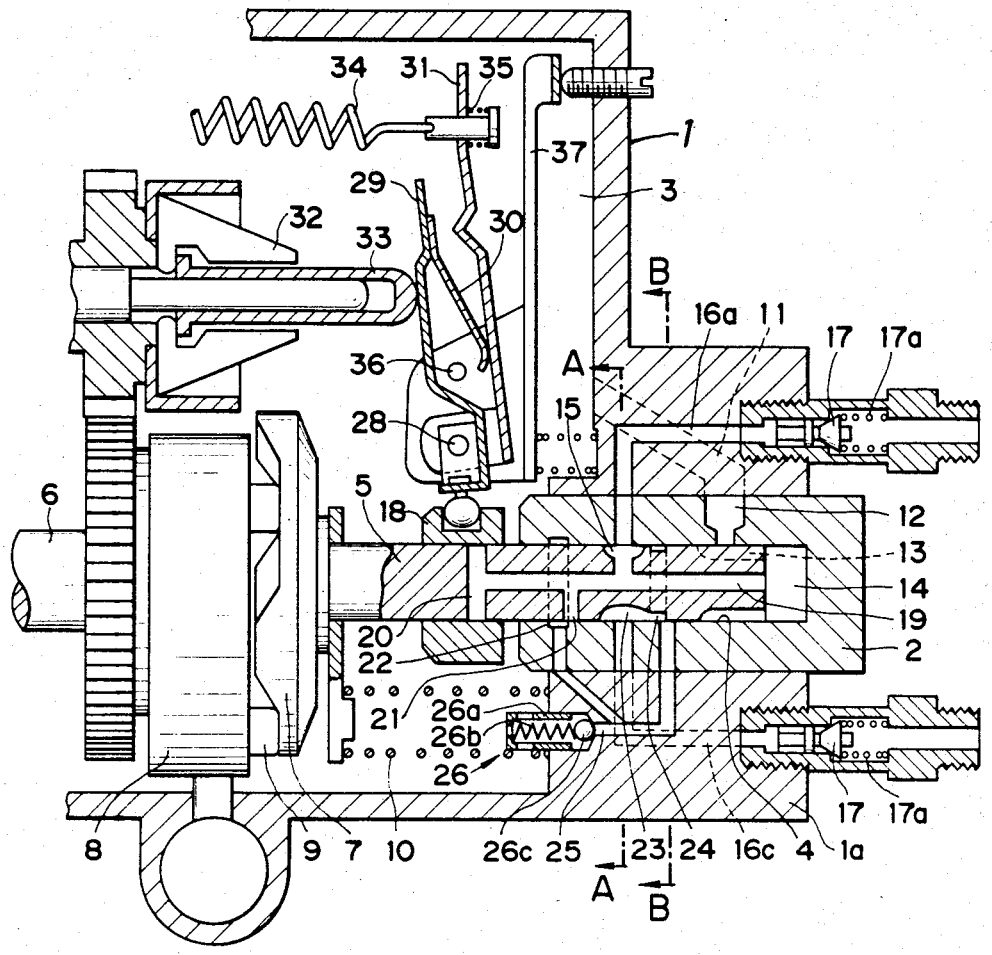
FIG. 1 is a cross section showing an embodiment of this invention.

The embodiments of this invention will now be described by referring to the drawings.

Figure 2:
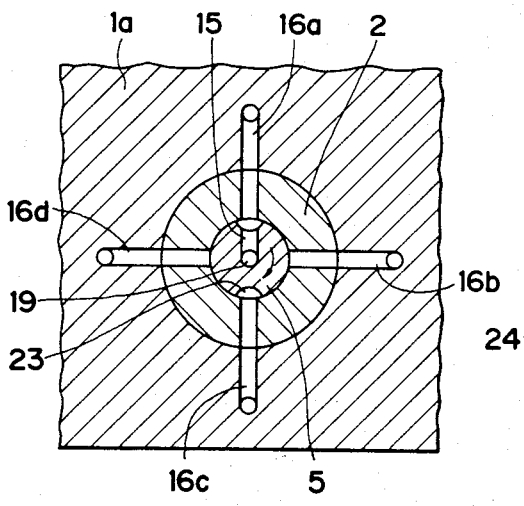
FIG. 2 is a cross section taken along a line A—A of FIG. 1.
Figure 3:
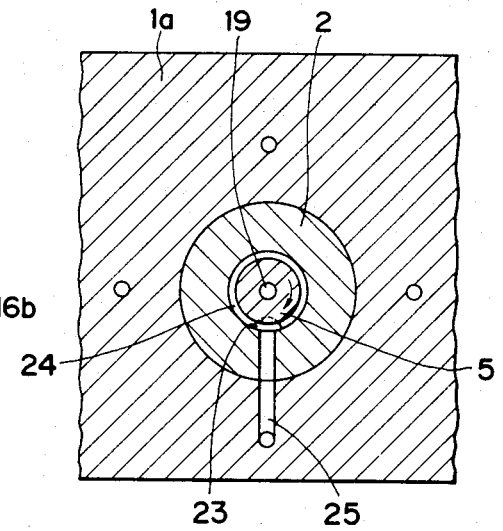
FIG. 3 is a cross section taken along a line B—B of FIG. 1.

In FIG. 1 through FIG. 3, the fuel is supplied to a chamber 3 in a pump housing 1 by means of a feed pump (not shown) that is driven by the engine to which fuel is supplied by the pump. Since the internal pressure in the chamber 3 is controlled by a pressure control valve whose function is related to r.p.m. (revolutions per minute) of the engine as it is well known, the internal pressure is proportionally increased as the r.p.m. is increased.

In a sliding bore 4 of a plunger barrel 2 provided in the pump housing 1, a plunger 5 is slidably installed, and this plunger 5 is caused to rotate simultaneously with the reciprocation by a plunger rotating means to be described hereinafter.

The plunger rotating means has a drive shaft 6 and a cam disc 7 fixed to a base portion of plunger 5 connected in the rotating direction by means of a driving disc, and a cam surface of the cam disc 7 having a shape including projections corresponding to the number of cylinders of the engine is urged against a roller 9 retained on a roller holder 8 by means of a plunger spring 10 so that the reciprocation of the plunger 5 for suction pressure feed of the fuel and the rotation for distribution are carried out simultaneously.

When the plunger 5 is in a suction stroke moving in the lefthand direction in FIG. 1, the fuel in the chamber 3 is supplied to a pump chamber 14 at the inner end of bore 4 from a suction port 12 and a supply path 11 through one of a plurality of suction grooves 13 formed on the outer periphery of the inner end portion of the plunger 4 and parallel to the axis of the plunger.

When the plunger 5 is shifted in a pressure feed stroke, the suction port 12 and the suction grooves 13 are separated, and the fuel in the pump chamber 14 is compressed, and is supplied to one of distribution paths 16*a*–16*d* (corresponding to the number of cylinders in the engine and spaced in the circumferential direction around the bore 4) from the distribution port 15 through an axial bore 19 in the plunger 5, and is sent to the injection nozzle (not shown) from the delivery valve 17, and is injected into the corresponding cylinder.

This delivery valve 17 employed in this embodiment has a large suction return quantity, and the residual pressure in the injection pipe is lowered to zero or near zero.

Also, on the portion of the plunger 5 projecting into the chamber 3, a control sleeve 18 is slidably mounted, and when a cut-off port 20 communicated with the axial bore 19 of the plunger 5 opens to the chamber 3 when it comes out from under the control sleeve 18, the fuel flows out to the chamber 3, so that the outflow of the fuel to the delivery valve 17 is suspended, and the injection is completed. Accordingly, the completion of the injection changes due to the adjustment of position of the control sleeve 18, namely, the quantity of fuel injected can be controlled, for example, when the control sleeve 18 is shifted to the left in the drawing, the quantity of fuel injected is decreased.

An auxiliary port 21 communicated with the axial bore 19 is formed in the plunger 5, and a groove 22 for taking out the pressure by being aligned with the auxiliary port 21 is formed in the inner peripheral surface of the plunger barrel 2, and the pressure is taken out at a time during a stroke (hereinafter referred to as a prestroke) when the auxiliary port 21 and the groove 22 are aligned. For a four cylinder engine, the plunger 5 has four motions in the left direction and the pressure is taken out at each motion.

Also, a pressure equalizing slit 23 is formed in the plunger 5 at an identical position with the distribution port, for example, at a position circumferentially offset by 180° from port 15, and the pressure equalizing port 23 is sequentially communicated with each distribution path **16*a*–16*d* during the rotation of the plunger 5**.

The pressure equalizing slit is connected with an annular groove 24 provided in either the plunger 5 or the inner peripheral surface of bore 4, and the annular groove 24 is communicated with the communicating path 25 formed in the plunger barrel 2 and the head **1*a*. This communicating path 25 is communicated with the annular groove 24 for taking out the pressure, and with the groove 22, and the communicating path 25 is provided with a pressure equalizing valve 26 for keeping the internal pressure (residual pressure) of the communicating path constant, and the excessive pressure is released to the pump chamber 3. Accordingly, when the auxiliary port 21 is communicated with the groove 22, the pressure is made to flow to the pressure equalizing slit 23 by means of the communicating path 25, and enters the injection pipe from the distribution paths 16*a*–16*d* superposed with the pressure equalizing slit 23**, and the internal pressure in the injection pipe is set at the desired residual pressure.

The pressure equalizing valve 26 is ordinarily a check valve, and is composed of a spring **26*a* provided in a valve case 26*a* mounted on the head 1*a* and a valve body 26*c* urged against a valve seat by this spring, and the pressure in the communicating path 25 is determined by the set force of the spring 26*b***.

The control sleeve 18 is engaged with one end portion of a start lever 29 whose middle portion is pivotally supported on a support shaft 28, and the lever 29 is displaced in the direction of a counter tension lever 31 by the elastic force of a start spring 30 with the support shaft 28 as a fulcrum, and is engaged with a sleeve 33 of a centrifugal governor 32 at one side of the counter tension lever at its other end.

The tension lever 31 is caused to operate a governor spring 34 and an idling spring 35 whose spring force is adjusted by a speed lever (not shown) interlocking with an accelerator in a direction opposite to the working direction of the centrifugal governor 32.

Thus, the position control of the tension lever 31 is effected by a balance of the working force of the centrifugal governor 32 and the working force of the governor spring 34, and the position adjustment of the control sleeve 18 is effected by means of the start lever 29.

Also, the support shaft 28 of the start lever 29 and the tension lever 31 is mounted at a lower end portion of a contact lever 37 pivotally supported rotatably on an immovable stationary shaft 36.

In the foregoing construction, when the engine is started, and the drive shaft 6 is rotated, the plunger 5 is reciprocally moved and is rotated, and when the plunger 5 is moved from an upper dead point to the left, the suction port 12 and the groove 13 are communicated and the fuel is sucked into the pump chamber, and when the plunger 5 is moved from a lower dead point to the right, the suction portion 12 and the groove 13 are shut-off, and the distribution port 15 moves to a position where it is communicated with the distribution path **16*a* for feeding the fuel to one of a plurality of cylinders, and the pressurized fuel forces the delivery valve 17 to open as it moves through the distribution path 16*a*, and the fuel is pressure fed to the fuel injection nozzle (not shown), and is injected into the engine. The completion of the fuel injection occurs when the cut off port 20 is moved out from under the control sleeve 18 and is communicated with the pump chamber 3, the pressure in the pump chamber 14 is lowered, and the delivery valve 17 is closed by the spring 17*a***, and the internal pressure of the injection pipe is lowered to zero or near zero by the suction return stroke at that time.

When the plunger 5 is moving to the right from the lower dead point and the auxiliary port 21 and the groove 22 are communicated (prestroke), the pressurized fuel enters the communicating path 25, and the pressure setting (a value P1 slightly lower than the valve opening pressure) is effected by the pressure equalizing valve 26, and the fuel is made to flow to the distribution path **16*c* for feeding it to one of a plurality of the cylinders from the pressure equalizing slit 23, and forces the delivery valve 17** to open and is pressure fed to the injection pipe, and the internal pressure in the injection pipe rises from the pressure zero or near zero to a pressure (residual pressure) with a value slightly lower than the valve opening pressure.

In this embodiment, a four-cylinder engine is used, and when the ignition order in the order 1, 3, 4, 2, at the first injection time, the pressure for generation of the residual pressure is pressure fed to the injection pipe connected to the fourth injection nozzle to be injected at the third time by means of the distribution path **16*c* which is circumferentially spaced 180° from the distribution path 16*a* for the first cylinder, and at the second injection time, it is pressure fed to the injection pipe connected to the second injection nozzle to be injected at the fourth time by means of the distribution path 16*d*, and at the third injection time, it is pressure fed to the injection pipe connected to the first injection nozzle to be injected at the first time by means of the distribution path 16*a*, and at the fourth injection time, it is pressure fed to the injection pipe connected to the third injection nozzle to be injected at the second time by means of the distribution path 16*b***.

Figure 4:
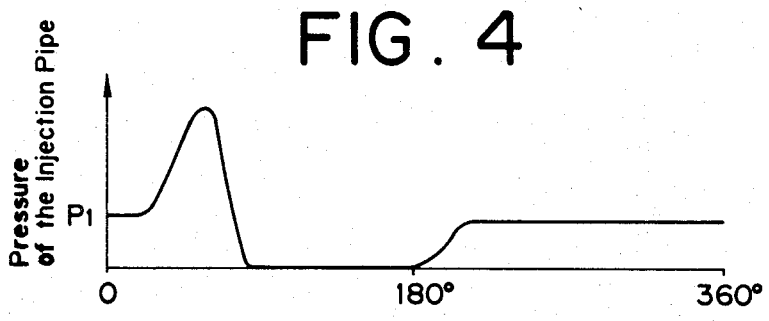
FIG. 4 is a characteristic curve for the fuel injection pump of this invention.

FIG. 4 shows the characteristics of the internal pressure of the injection pipe connected to the fuel injection nozzle, and when the injection is completed, the residual pressure in the injection pipe is lowered to zero or near zero, and when the supply of pressure for generation of the residual pressure occurs, the internal pressure of the injection pipe is raised to a fixed residual pressure P1 (for example, a proper value in the range of 150 $kg/cm^2$–200 $kg/cm^2$) before the injection.

In this embodiment, the engine having four cylinders is described, but it is of course applicable to a two cylinder engine or a six cylinder engine, and a similar operation and effect can be obtained.

Figure 5:
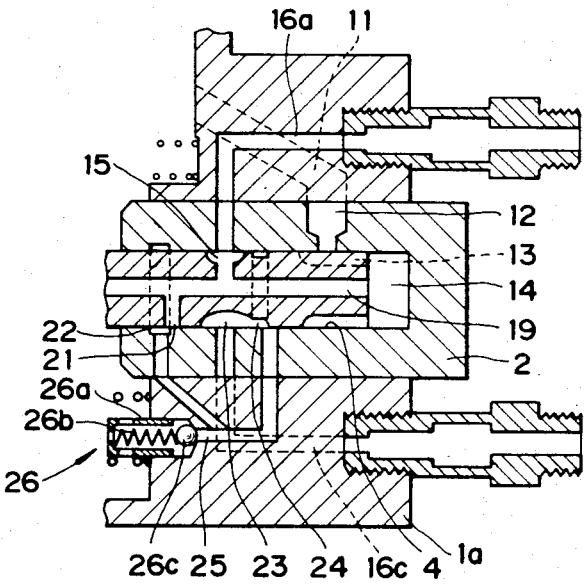
FIG. 5 is a cross section of an essential part of another embodiment of this invention.

In FIG. 5, another embodiment of this invention is shown, and the point which is different from the foregoing embodiment is that the delivery valve provided in the distribution path is eliminated. However, the other parts are entirely identical with the foregoing embodiment, and the description is omitted like parts having identical reference numerals.

In the foregoing construction, when the engine is started and the drive shaft 6 is rotated, the plunger 5 is reciprocally moved and is rotated, and when the plunger is moving to the left from the upper dead point, the suction port 12 and the group 13 are communicated, and the fuel is sucked into the pump chamber 14, and when the plunger 5 is moving to the right from the lower dead point of the plunger 5, the suction port 12 and the group 13 are shut off, and the distribution port 15 is communicated with the distribution path 16*a* for feeding the fuel to one of a plurality of the cylinders, and the pressurized and is pressure fed to the fuel injection nozzle (not shown) and is injected into the engine. The completion of the fuel injection occurs when the cut-off port 20 is communicated with the pump chamber 3 as it is moved out from under the control sleeve 18, the pressure in the pump chamber 14 is lowered to the internal pressure of the pump chamber 3.

When the plunger 5 is moving to the right from the lower dead point and the auxiliary port 21 and the groove 22 are communicated (prestroke), the pressurized fuel enters the communicating path 25, and the pressure setting (a value P1 slightly lower than the valve opening pressure) is effected by the pressure equalizing valve 26, and is caused to flow to the distribution path 16*c* for feeding the fuel to one of a plurality of the cylinders from the pressure equalizing slit 23, and is pressure fed to the injection pipe, and the internal pressure of the injection pipe becomes a pressure (residual pressure) with a value slightly lower than the fuel injection pressure from a low pressure.

In this embodiment, a engine having four cylinders is used, and when the ignition order is in the order of 1, 3, 4, 2, at the first injection time, the pressure for generation of the residual pressure is pressure fed to the injection pipe connected to the fourth injection nozzle to be injected at the third time by means of the distribution path 16*c* which is offset by 180°, and at the second injection time, it is pressure fed to the injection pipe connected to the second injection nozzle to be injected at the fourth time by means of the distribution path 16*d*, and at the third injection time, it is pressure fed to the injection pipe connected to the first injection nozzle to be injected at the first time by means of the distribution path 16*a*, and at the fourth injection time, it is pressure fed to the injection pipe connected to the third injection nozzle to be injected at the second time by means of the distribution path 16*b*.

In this embodiment, in order to keep the pressure in the injection pipe elevated to the pressure of a value slightly lower than the valve opening pressure in the prestroke, the timing of communicating the distribution paths 16*a*–16*d* and the pump chamber 14 by means of the distribution port 15 for the fuel injection is delayed, and it must be set at the time when the prestroke is almost completed and the pressure is to be elevated. This is because the pressure of a value slightly lower than the valve opening pressure of the injection pipe flows backward.

What is claimed is:

1. In a distribution type fuel injection pump having a suction chamber for containing fuel, a plunger bore having a pump chamber in the inner end thereof and communicating with said suction chamber, a reciprocating and rotating plunger reciprocally and rotatably sliding in said plunger bore for drawing fuel from said suction chamber into said pump chamber and pressurizing it therein, a plurality of fuel distribution passages extending from said bore to supply pressurized fuel through injection pipes to corresponding fuel injection nozzles, said distribution passages opening into said bore at points spaced around the periphery thereof, said plunger having a distributing port communicating with said pump chamber and opening out of the peripheral surface of said plunger in alignment with the distribution passages when said plunger is in a position in which fuel is pressurized in said pump chamber, the improvement comprising:

a delivery valve in each of said fuel distribution passages which creates substantial suction downstream thereof when it closes for reducing the pressure in the fuel injection pipes at least to near zero, said plunger having an auxiliary port opening out of the periphery thereof spaced along the plunger from said distribution port and connected with said pump chamber, said bore having a groove therearound in a position to be aligned with said auxiliary port during the time of the stroke of said plunger when said distribution port is aligned with one of said distribution passages, a communicating passage in said pump opening into said plunger bore adjacent said distribution paths, said plunger having a uniform pressure slit therealong spaced circumferentially from said distribution port by an amount of at least the spacing of said distribution paths around the circumference of said bore and having the end thereof aligned with said communicating passage for receiving pressurized fuel from said communicating passage and delivering it to a distribution passage other than the distribution passage to which pressurized fuel is being delivered from said distribution port, and a pressure equalizing valve in said communicating passage for limiting the pressure of the fuel in said communicating passage to a pressure slightly less than the pressure required to open the fuel injection nozzles.

2. The improvement as claimed in claim 1 in which said pressure equalizing valve opens into said suction chamber.

3. The improvement as claimed in claim 1 in which said pressure equalization valve is a check valve.

4. In a distribution type fuel injection pump having a suction chamber for containing fuel, a plunger bore having a pump chamber in the inner end thereof and communicating with said suction chamber, a reciprocating and rotating plunger reciprocally and rotatably sliding in said plunger bore for drawing fuel from said suction chamber into said pump chamber and pressurizing it therein, a plurality of fuel distribution passages extending from said bore to supply pressurized fuel through injection pipes to corresponding fuel injection nozzles, said distribution passages opening into said bore at points spaced around the periphery thereof, said plunger having a distributing port communicating with said pump chamber and opening out of the peripheral surface of said plunger in alignment with the distribution passages when said plunger is in a position in which fuel is pressurized in said pump chamber, said fuel distribution passages having substantial suction created therein when they are cut off from said distributing port by rotation of said plunger for reducing the pressure in the fuel injection pipes at least to near zero, the improvement comprising:

said plunger having an auxiliary port opening out of the periphery thereof spaced along the plunger from said distribution port and connected with said pump chamber, said bore having a groove therearound in a position to be aligned with said auxiliary port during the time of the stroke of said plunger when said distribution port is aligned with one of said distribution passages, a communicating passage in said pump opening into said plunger bore adjacent said distribution paths, said plunger having a uniform pressure slit therealong spaced circumferentially from said distribution port by an amount of at least the spacing of said distribution paths around the circumference of said bore and having the end thereof aligned with said communicating passage for receiving pressurized fuel from said communicating passage and delivering it to a distribution passage other than the distribution passage to which pressurized fuel is being delivered from said distribution port, and a pressure equalizing valve in said communicating passage for limiting the pressure of the fuel in said communicating passage to a pressure slightly less than the pressure required to open the fuel injection nozzles.

5. The improvement as claimed in claim 4 in which said pressure equalizing valve opens into said suction chamber.

6. The improvement as claimed in claim 4 in which said pressure equalization valve is a check valve.

* * * * *